US006978649B1

(12) United States Patent
Alencar et al.

(10) Patent No.: US 6,978,649 B1
(45) Date of Patent: Dec. 27, 2005

(54) METHOD AND APPARATUS FOR PRODUCING A VEHICLE WHEEL RIM

(75) Inventors: Milton Alves Alencar, Rua Sonho Gaucho (BR); Jose Francisco Gracia Flores, Rua Barber Greene (BR)

(73) Assignee: Hayes Lemmerz International, Inc., Northville, MI (US)

( * ) Notice: Subject to any disclaimer, the term of this patent is extended or adjusted under 35 U.S.C. 154(b) by 46 days.

(21) Appl. No.: 10/683,174

(22) Filed: Oct. 10, 2003

(51) Int. Cl.[7] ..... B21D 15/04
(52) U.S. Cl. ..... 72/105; 29/894.354
(58) Field of Search ..... 72/105, 106, 107, 72/110, 125; 29/894.322, 894.324, 894.354

(56) References Cited

U.S. PATENT DOCUMENTS 4,170,888 A * 10/1979 Golata ..... 72/82
4,554,810 A * 11/1985 Jurus ..... 72/70
5,121,866 A * 6/1992 Hakoun et al. ..... 225/96.5
5,454,248 A * 10/1995 Inatani ..... 72/84
5,515,709 A * 5/1996 Lowe et al. ..... 72/105
5,740,609 A * 4/1998 Jurus ..... 29/894.324
6,026,667 A * 2/2000 Takamoku ..... 72/105

FOREIGN PATENT DOCUMENTS

DE 1299269 * 7/1969 ..... B21D 53/30

* cited by examiner

*Primary Examiner*—Ed Tolan
(74) *Attorney, Agent, or Firm*—MacMillan, Sobanski & Todd, LLC

(57) ABSTRACT

This invention relates an improved wheel rim roll forming apparatus for producing a vehicle wheel rim. The wheel rim roll forming apparatus includes an inner member adapted to support a flared wheel rim preform thereon, an outer member supported relative to the inner member, and a pair of adjustable members operatively supported by inner member. The inner member includes an outer surface having a predetermined profile and defining a centerline of the apparatus. The outer member includes an inner surface having a predetermined profile adapted to engage the flared wheel rim preform to produce a partially formed wheel rim having a desired profile. The pair of adjustable members are disposed adjacent an associated end of the flared wheel rim preform. At least one of the adjustable members is adjustable, by one of a rotational or axial movement thereof, in an axial direction with respect to the centerline of the apparatus.

15 Claims, 12 Drawing Sheets

METHOD AND APPARATUS FOR PRODUCING A VEHICLE WHEEL RIM

BACKGROUND OF THE INVENTION

This invention relates in general to vehicle wheels and in particular to an improved method and apparatus for producing a vehicle wheel.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding.

A full face vehicle wheel is distinguished from other types of wheels by having a one-piece wheel disc construction. In particular, the full face wheel includes a "full face" wheel disc and a "partial" rim. The full face wheel disc can be cast, forged, or fabricated from steel, aluminum, or other alloys. The full face wheel disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial wheel rim is fabricated from steel, aluminum, or other alloys, and includes an inboard tire bead seat retaining flange, an inboard tire bead seat, an axially extending well, and an outboard tire bead seat. In some instances, the outboard tire bead seat of the wheel rim and the outer annular portion of the wheel disc cooperate to form the outboard tire bead seat retaining flange of the full face wheel. In both types of constructions, the outboard tire bead seat of the wheel rim is positioned adjacent the outer annular portion of the wheel disc and a weld is applied to join the wheel rim and the wheel disc together.

In the above wheel constructions, the wheel rim of the associated vehicle wheel is typically subjected to a series of roll forming operations to produce a partially finished wheel rim having a desired final profile prior to subjecting the wheel rim to final forming operations. A typical sequence of steps which can be used to produce a full wheel rim for use in a conventional type of vehicle wheel is disclosed in U.S. Pat. No. 4,185,370 to Evans. As shown in this patent, the method includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the flared rim preform to a series of roll forming operations to produce a partially formed wheel rim having a predetermined shape; and (e) expanding the partially formed wheel rim to a produce a finished wheel rim having a predetermined circumference. A sequence of steps which can be used to produce a partial wheel rim for use in a full face type of vehicle wheel is disclosed in U.S. Pat. No. 5,579,578 to Ashley, Jr.

Prior art FIG. 1 illustrates a prior art wheel rim roll forming apparatus, indicated generally at 200, which can be used in the step (d) above to subject a flared wheel rim preform (shown in phantom in prior art FIG. 1 at 202), to a series of roll forming operations to produce a partially formed wheel rim (202') having a predetermined shape. As shown therein, the prior art wheel rim roll forming apparatus 200 includes a guide ring 204 that is positioned at a predetermined location with respect to the wheel rim preform 202. Other than an inboard roll 210 and an outboard roll 212 of the apparatus 200, the components of the apparatus 200 on a right hand side and a left hand side thereof are generally the same. Therefore, any discussion of the components on one side of the prior art wheel rim forming apparatus 200 will apply to the other side thereof.

The guide ring 204 is generally L-shaped and has an outer flanged portion 206 which defines an inner surface 206A. The inner surfaces 206A of the guide rings 204 are operative to define a width W therebetween. The width W corresponds to a desired width of the partially formed wheel rim 202'. Thus, any tolerance variations in the flared wheel rim preform 202 can be adjusted for by changing the position of one or both of the guide rings 204 as will be discussed below. Typically, the inner surfaces 206A of the guide rings 204 are equally spaced apart from a centerline C of the apparatus 200.

The guide ring 204 holds the flared wheel rim preform 202 in a relatively fixed position relative to the inboard roll 210 and the outboard roll 212. The flared wheel rim preform 202 is also positioned on and is supported relative to the inboard roll 210 and outboard roll 212. The inboard roll 210 is positioned within the prior art wheel rim forming apparatus 200 by spacer 214, shown schematically in FIG. 1.

The inboard roll 210 defines a first portion of an inner engaging face 218 for the wheel rim preform 202. The outboard roll 212 is positioned within the apparatus 200 by an outboard spacer 216, that is also shown schematically in FIG. 1. The outboard roll 212 defines a second portion of an inner engaging face 220 for the wheel rim preform 202. The overall engaging face shape is predetermined to impart a desired shape to the partially formed wheel rim 202'. The inboard roll 210 and outboard roll 212 also have mating faces that engage each other. The inboard roll 210 includes a female mating face 222 that engages a male mating face 224 on the outboard roll 212. When the inboard mating face 222 and outboard mating face 224 are mated, the respective first and second portions of the engaging faces 218, 220 of the inboard and outboard rolls 210, 212 define the entire inner engaging face for the producing the partially formed wheel rim 202'. Thus, the mated inboard roll 210 and outboard roll 212 cooperate to define an inner roll assembly, indicated generally at 226.

The inner roll assembly 226 is separated from the guide ring 204 on each side of the apparatus 200 by a lateral ring 228 that is fitted about the respective inboard 210 and outboard portions 212 of the inner roll assembly 226. Each lateral ring 228 is secured to the roll member 210 by a plurality of fasteners or bolts 230 (only one of such bolts 230 being illustrated in prior art FIG. 1). Thus, 20 the lateral rings 228 are securely connected to the inner roll assembly 226.

Each of the guide rings 204 is securely connected to an associated lateral ring 228 and the inner roll assembly 226 by a plurality of fasteners or bolts 232. Typically, the bolts 232 are located around an outboard face 204A of each guide ring 204 and between the positions of each of the bolts 230 so that the bolts 232 do not contact or interfere with the bolts 230. Thus, during operation of the prior art wheel rim forming apparatus 200, each guide ring 204 is securely held to an associated lateral ring 228 and to the inner roll assembly 226 by the bolts 232.

The prior art wheel rim forming apparatus 200 also includes an outer roll member 234, that is positioned generally above the flared wheel rim preform 202, and thus, above the engaging face of the inner roll member 226. The outer roll member 234 is provided with an engaging face 236 having a predetermined profile or shape which is operative to impart a desired shape to the partially formed wheel rim 202'. During operation of the prior art wheel rim forming apparatus 200, the upper roll member 234 is lowered and rotated in a known manner so as to engage the flared wheel rim preform 202 during an initial roll forming operation. Thus, as is known, the lower roll assembly 226 and upper roll assembly 234 are operative subject the flared wheel rim preform 202 to an initial roll forming operation to produce the partially formed wheel rim 202' having a desired profile or shape. The upper roll assembly 234 is positioned and held within the prior art roll forming apparatus 200 by a pair of spacers 238, 240 (shown schematically in FIG. 1) positioned on the opposed sides thereof.

In order to accurately position the flared wheel rim preform 202 on the prior art wheel rim forming apparatus so that the associated flanges of the finished wheel rim (not shown) will be within acceptable tolerances (i.e., W1 is approximately equal to W2), the position of the prior art guide rings 204 is changed or adjusted to accommodate for variations in width of the flared wheel rim preform 202. It can be appreciated, however, that W1 and W2 can be not equal to one another depending on the desired final structure of the finished wheel rim.

To adjust the position of the guide rings 204, the space between each guide ring 204 and the associated the lateral ring 228 can be varied to either increase or decrease the relative positions of the guide ring inner surfaces 206A with respect to the centerline C of the prior art wheel rim forming apparatus 200. To accomplish this, one or more shims 242 are placed/removed about the bolts 232 that connect the lateral ring 228 and the guide ring 204 together. This adjustment requires, as a first step, removing the bolts 232 (typically 4 bolts on each side for a total of eight bolts 232), from the associated components. Next, one or more shims 242 are added positioned about the bolts 232 on one side of the assembly 200 and one or more shims are removed from the bolts 232 on the opposite side of the assembly 200. Next, the bolts 232 are reinstalled through the guide ring 204 and the lateral ring 228 and threadably installed in the associated inboard roll 210 and outboard roll 212 threadably. As illustrated, the shims 242 are positioned about the guide bolts 232 between the guide ring 204 and lateral ring 228.

SUMMARY OF THE INVENTION

This invention relates an improved wheel rim roll forming apparatus for producing a vehicle wheel rim. The wheel rim roll forming apparatus includes an inner member adapted to support a flared wheel rim preform thereon, an outer member supported relative to the inner member, and a pair of adjustable members operatively supported by inner member. The inner member includes an outer surface having a predetermined profile and defining a centerline of the apparatus. The outer member includes an inner surface having a predetermined profile adapted to engage the flared wheel rim preform to produce a partially formed wheel rim having a desired profile. The pair of adjustable members are disposed adjacent an associated end of the flared wheel rim preform. At least one of the adjustable members is adjustable, by one of a rotational or axial movement thereof, in an axial direction with respect to the centerline of the apparatus.

Other advantages of this invention will become apparent to those skilled in the art from the following detailed description of the preferred embodiments, when read in light of the accompanying drawings.

Figure 10B:
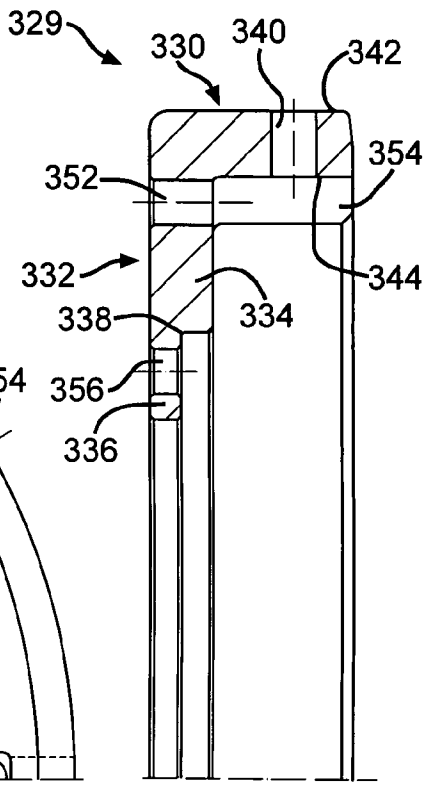
FIG. 10A is a partial elevational view of a guide ring in accordance with the present invention.
Figure 10A:
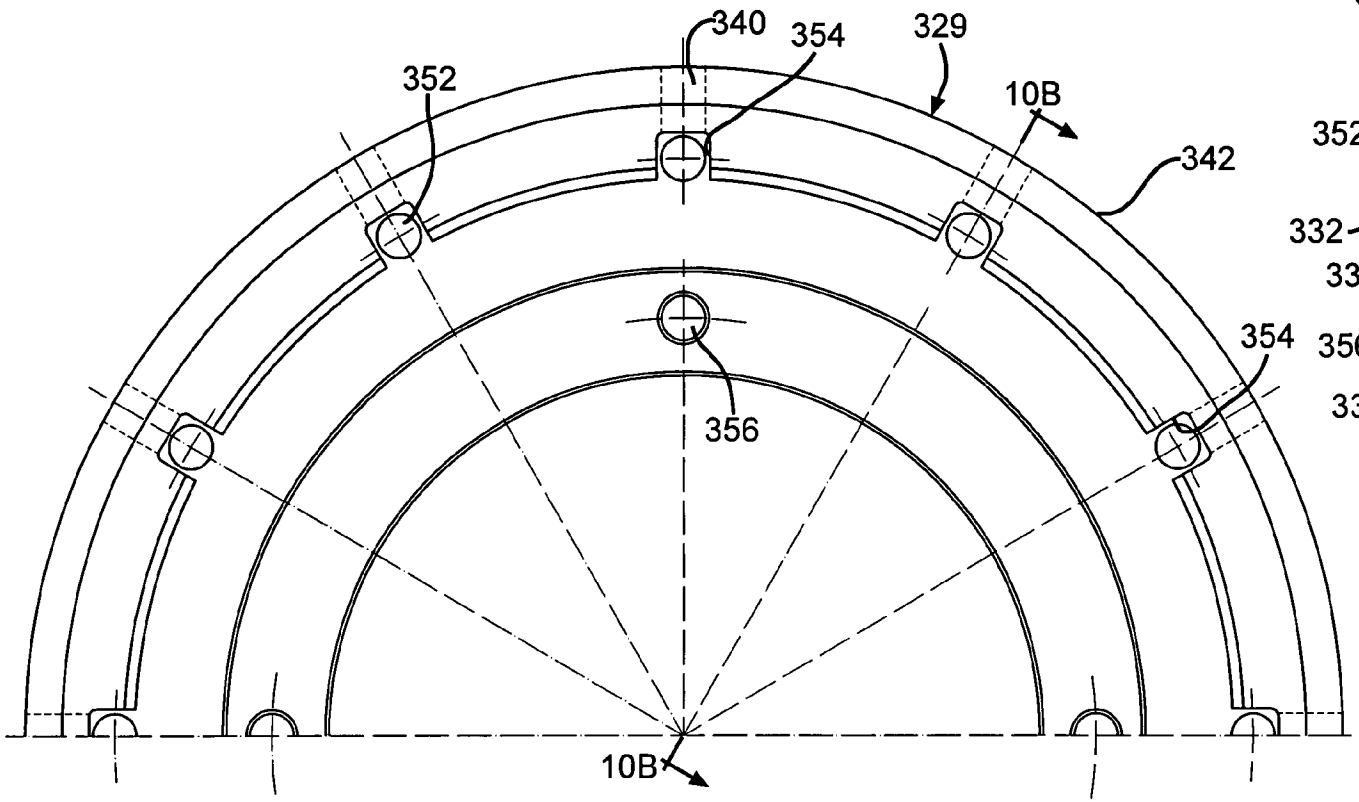

*Fig.* 10B is a partial cross sectional view of the guide ring of FIG. 10A along line 10B—10B of FIG. 10A.

Figure 8:
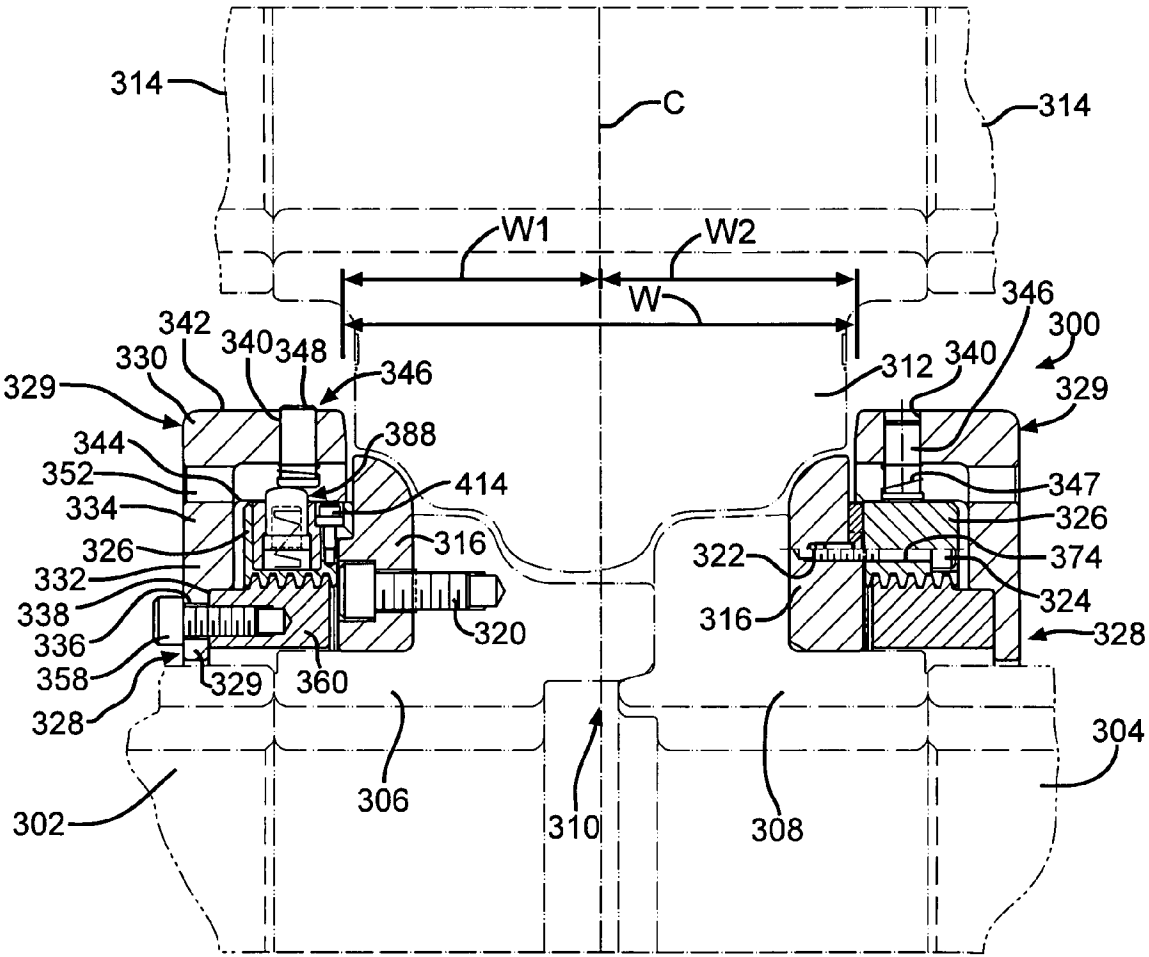
FIG. 8 is an elevational view of a wheel rim forming apparatus in accordance with the present invention.
Figure 11:
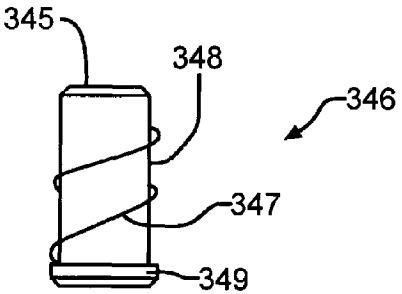

FIG. 11 is an elevational view of an actuator of the wheel rim forming apparatus shown in FIG. 8, in accordance with the present invention.

Figure 12A:
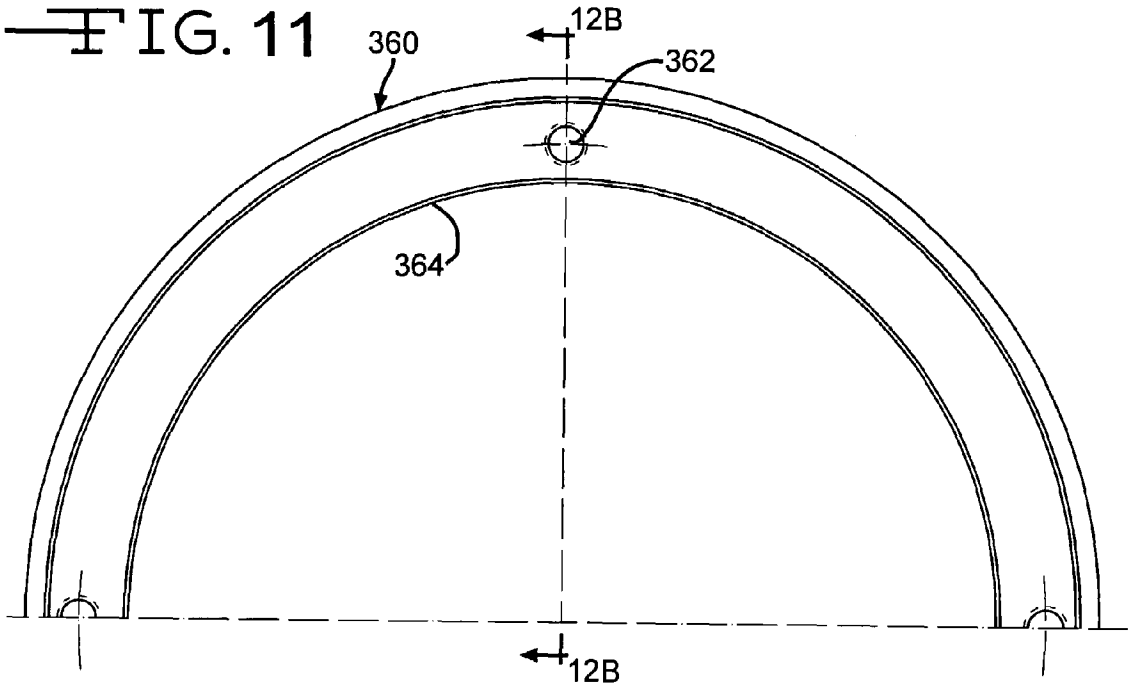

FIG. 12A is a partial elevational view of a bolt of the wheel rim forming apparatus shown in FIG. 8, in accordance with the present invention.

Figure 12B:
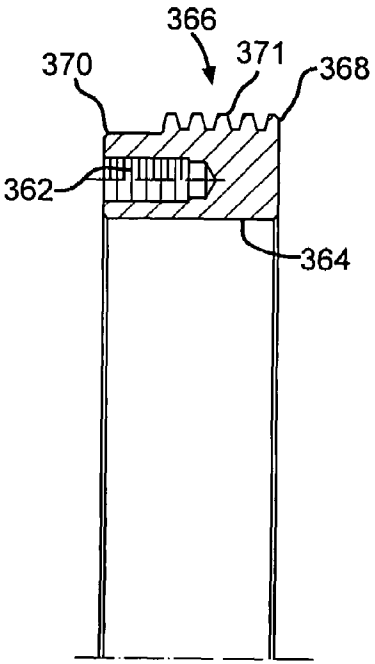

FIG. 12B is a partial cross sectional view of the bolt taken along line 12B—12B of FIG. 12A.

Figure 13A:
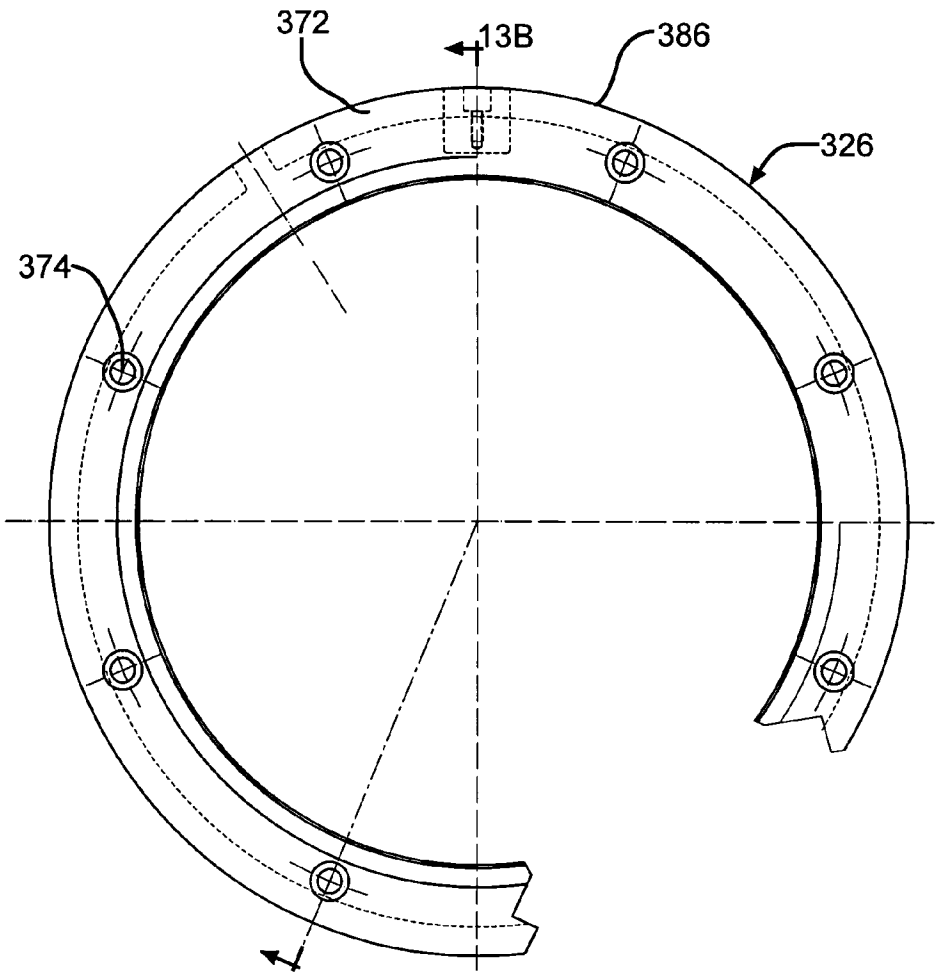

FIG. 13A is a partial elevational view of a nut of the wheel rim forming apparatus shown in FIG. 8, in accordance with the present invention.

Figure 13B:
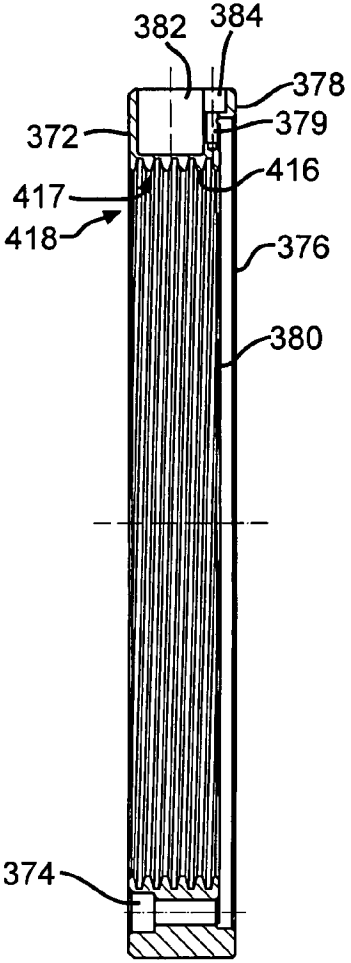

FIG. 13B is a cross sectional view of the nut taken along line 13B—13B of FIG. 13A.

Figure 14:
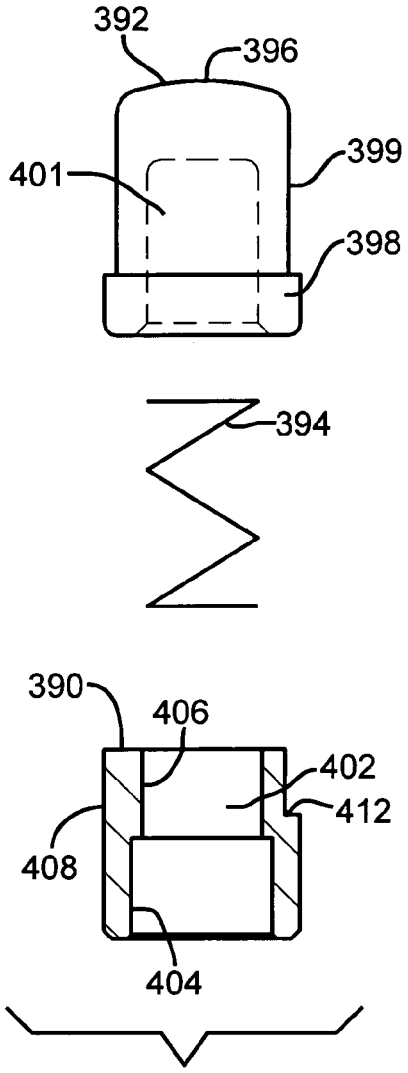

FIG. 14 is an exploded view of a locking assembly of the wheel rim forming apparatus shown in FIG. 8, in accordance with the present invention.

Figure 15:
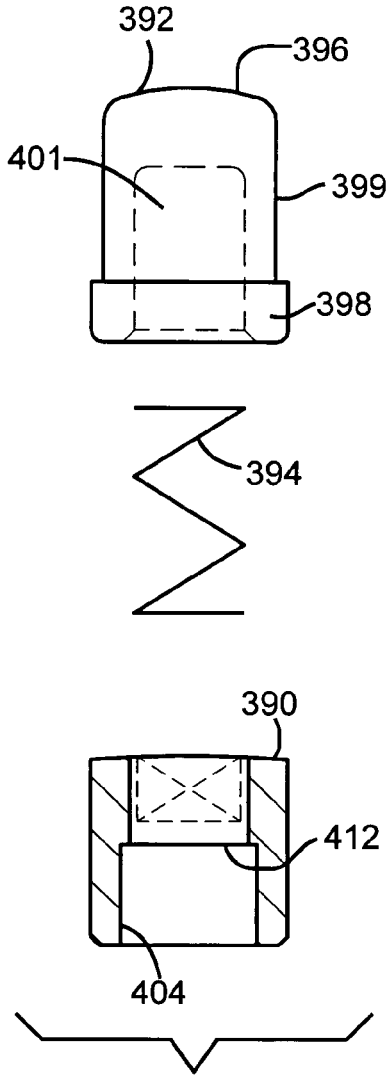

FIG. 15 is another exploded view of the locking assembly shown in FIG. 14.

Figure 16A:
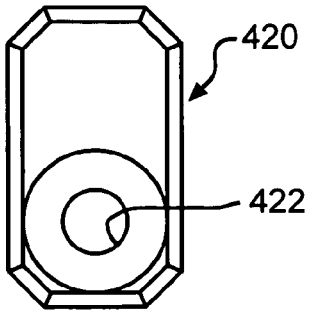
Figure 16B:
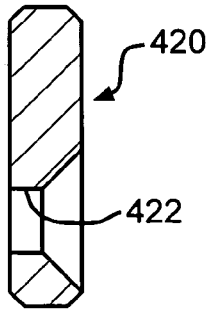

FIGS. 16A and 16B are views of a key of the wheel rim forming apparatus shown in FIG. 8, in accordance with the present invention.

Figure 17:
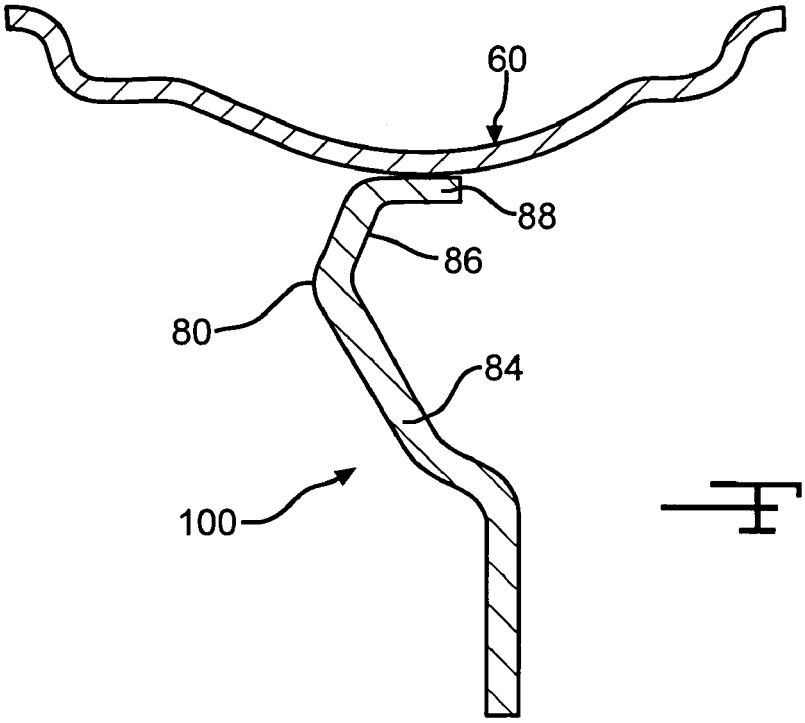

FIG. 17 is a partial sectional view of a first embodiment of a vehicle wheel constructed using a wheel rim produced using the wheel rim forming apparatus in accordance with the present invention.

Figure 18:
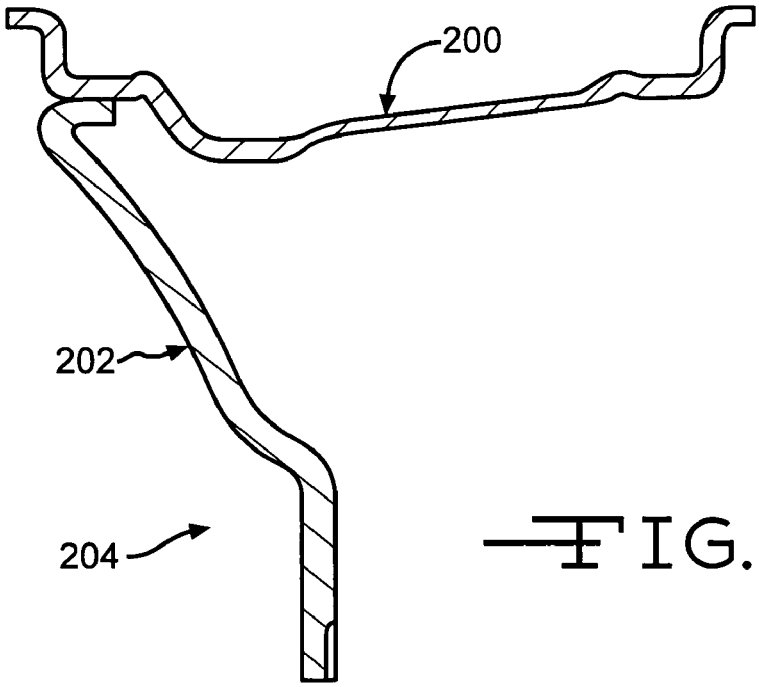

FIG. 18 is a partial sectional view of a second embodiment of a vehicle wheel produced using a wheel rim produced using the wheel rim forming apparatus in accordance with the present invention.

Figure 19:
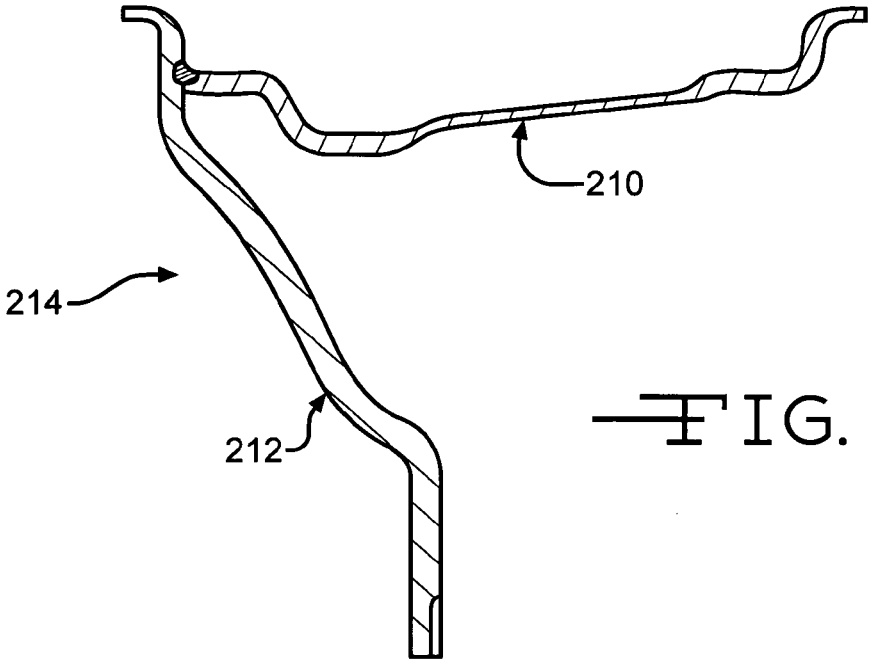

FIG. 19 is a partial sectional view of a third embodiment of a vehicle wheel produced using a wheel rim produced using the wheel rim forming apparatus in accordance with the present invention.

Figure 20:
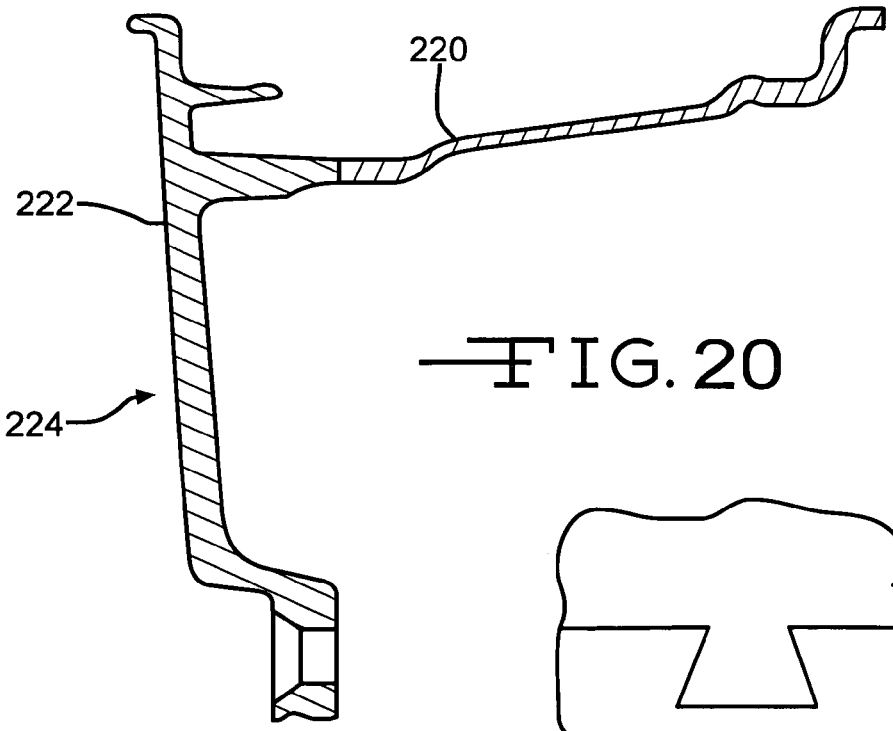

FIG. 20 is a partial sectional view of a fourth embodiment of a vehicle wheel produced using a wheel rim produced using the wheel rim forming apparatus in accordance with the present invention.

Figure 21:
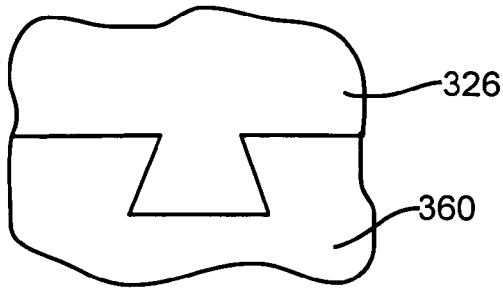

FIG. 21 is a view of a portion of an alternate embodiment of the present invention.

DESCRIPTION OF THE PREFERRED EMBODIMENTS

Preliminarily, it should be noted that certain terms used herein, such as "upper", "lower", "top", "bottom", "front", "back", "backward", "forward", "left", "right", "height", "width", "length", and "side", are used to facilitate the description of the preferred embodiments of the invention. Unless otherwise specified or made apparent by the context of the discussion, such terms should be interpreted with reference to the figure under discussion. Such terms are not intended as a limitation on the position in which the components of the invention may be used. Indeed, it is contemplated that the components of the invention may be easily positioned in any desired orientation for use. In addition, the terms "inboard" and "outboard" are also used in conjunction with the description of the preferred embodiments of the invention. For the purpose of facilitating this description the term "inboard" is intended to mean that a component is at a position closer to the roll portion of the apparatus. The term "outboard" is intended to mean that a component is at a position farther away from the roll portion of the apparatus.

Figure 2:
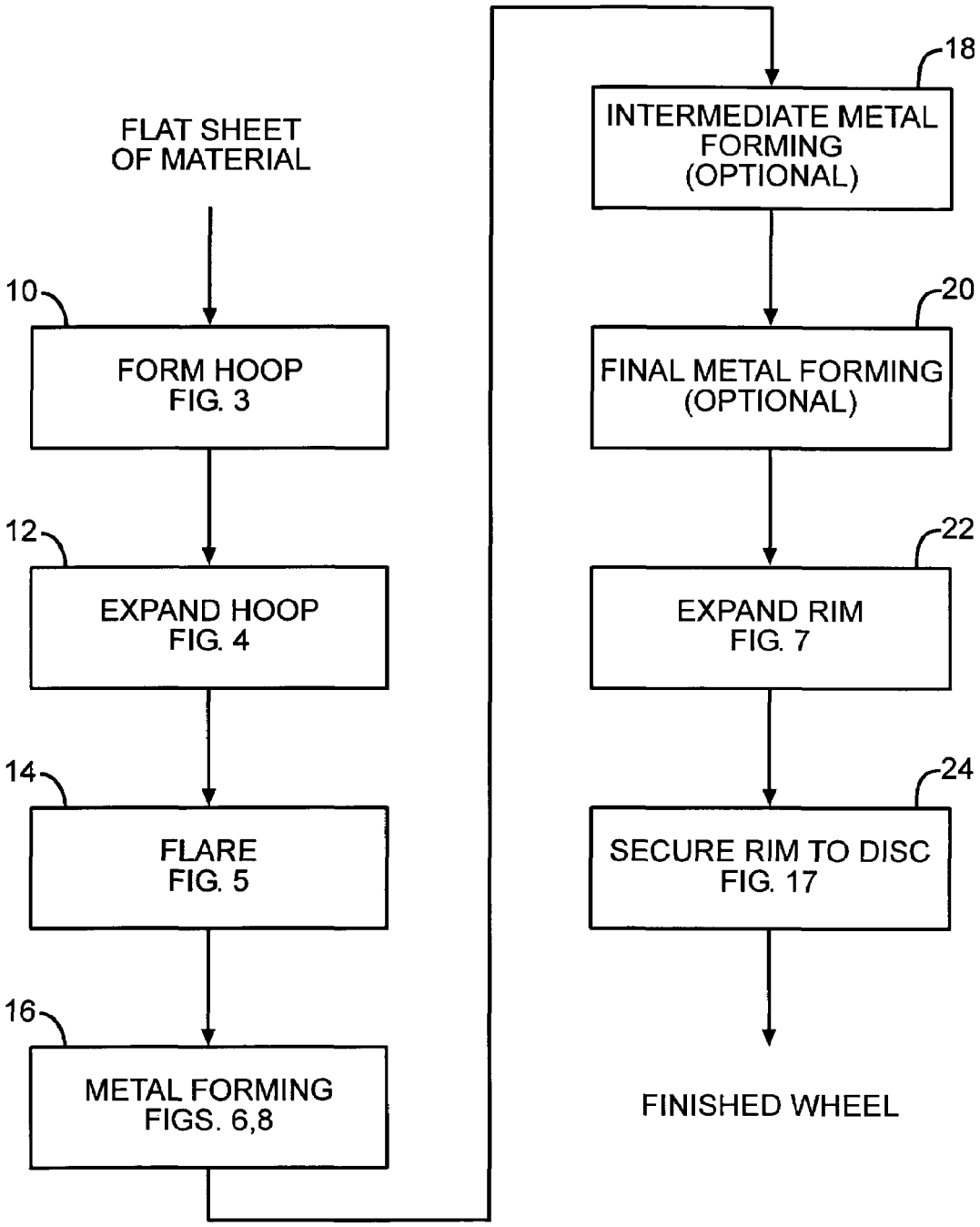
FIG. 2 is a block diagram showing a sequence of steps for producing a wheel rim for use in a vehicle wheel in accordance with the present invention.

Referring now to the drawings, there is illustrated in FIG. 2 a block diagram showing a sequence of steps for producing a first embodiment of a vehicle wheel 100, such as shown in FIG. 17, and which incorporates a first embodiment of a wheel rim, indicated generally at 60, and constructed in accordance with this invention. As shown in this embodiment, the vehicle wheel 100 is a well attached vehicle wheel having an outer full wheel rim 60. While the present invention will be described and illustrated in connection with the particular vehicle wheels disclosed herein, it is understood that the invention can be used to produce a wheel rim for use in constructing other types of vehicle wheels, if so desired.

Figure 3:
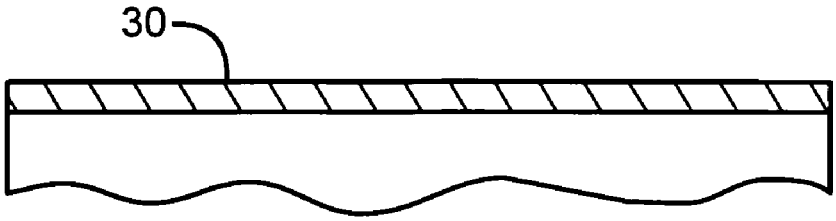
FIG. 3 is a schematic diagram of a wheel rim blank being formed into a hoop.
Figure 4:
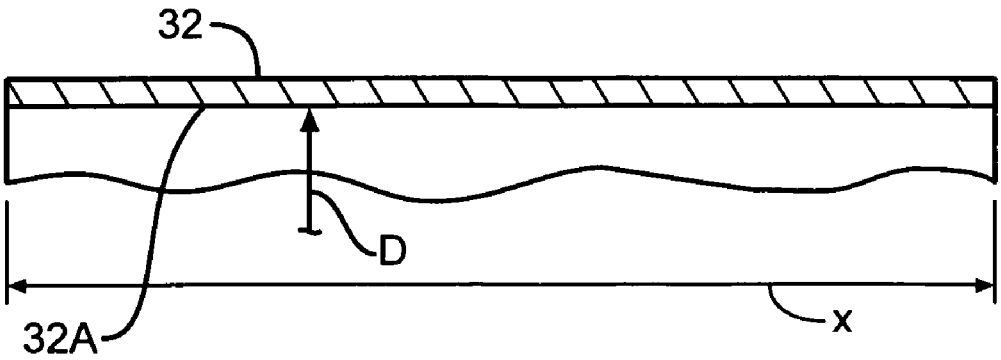
FIG. 4 is a schematic diagram of the hoop after an expanding operation.

Initially in step 10, a flat sheet of suitable material, such as for example, steel, aluminum, or alloys thereof, is formed into a generally cylindrical hoop or band and is welded to produce the hoop 30 shown in FIG. 3. When the hoop 30 is welded in step 10, a flat surface (not shown) is typically created by the weld. As a result of this, the hoop 30 is expanded in step 12 to produce a substantially cylindrical hoop 32 shown in FIG. 4. The hoop 32 extends a predetermined axial length X and includes an inner surface 32A which defines a predetermined inner diameter D thereof.

Figure 5:
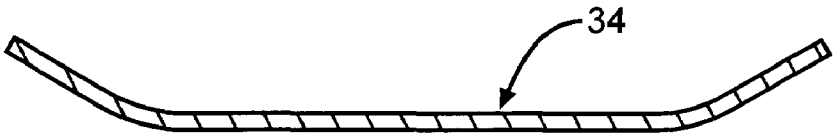
FIG. 5 is a schematic diagram of a wheel rim preform produced by a flaring operation.

Next, in step 14, the opposed ends of the hoop 32 are flared upwardly to produce a wheel rim preform 34 shown in FIG. 5. Following this, in step 16 (and optional steps 18, and 20 if performed), the flared wheel rim preform 34 is subjected to one metal forming operation (or a series of metal forming operations), to produce a partially formed wheel rim 36. Preferably, the metal forming operation of step 16 (and optional steps 18, and 20 if performed), include subjecting the wheel rim preform 34 to one or more roll forming operations as will be discussed below. Alternatively, other metal forming operations can be used following the roll forming operation of step 16 in optional steps 18 and 20) to produce the wheel rim 60. For example, following the roll forming step 16, the partially formed wheel rim can be subjected to forward or reverse flow spinning operation(s), pressing operation(s), or any suitable combinations of additional roll forming, flow spinning, and pressing operations which are operative to cause deformation, reshaping, and/or thinning of the metal to produce a wheel rim 60 having a desired profile. Also, while one or three metal forming operations are illustrated by steps 16, or steps 16, 18 and 20, the number of steps can be other than illustrated, if so desired.

Next, in step 22, the partially formed wheel rim 36 is expanded to produce the finished wheel rim 60. To accomplish this, the wheel rim 38 is supported by suitable support means (not shown) to enable the wheel rim 38 to be processed in accordance with a vehicle wheel rim expanding tooling apparatus. The general structure and operation of the wheel rim expanding tooling apparatus is conventional in the art.

Figure 1:
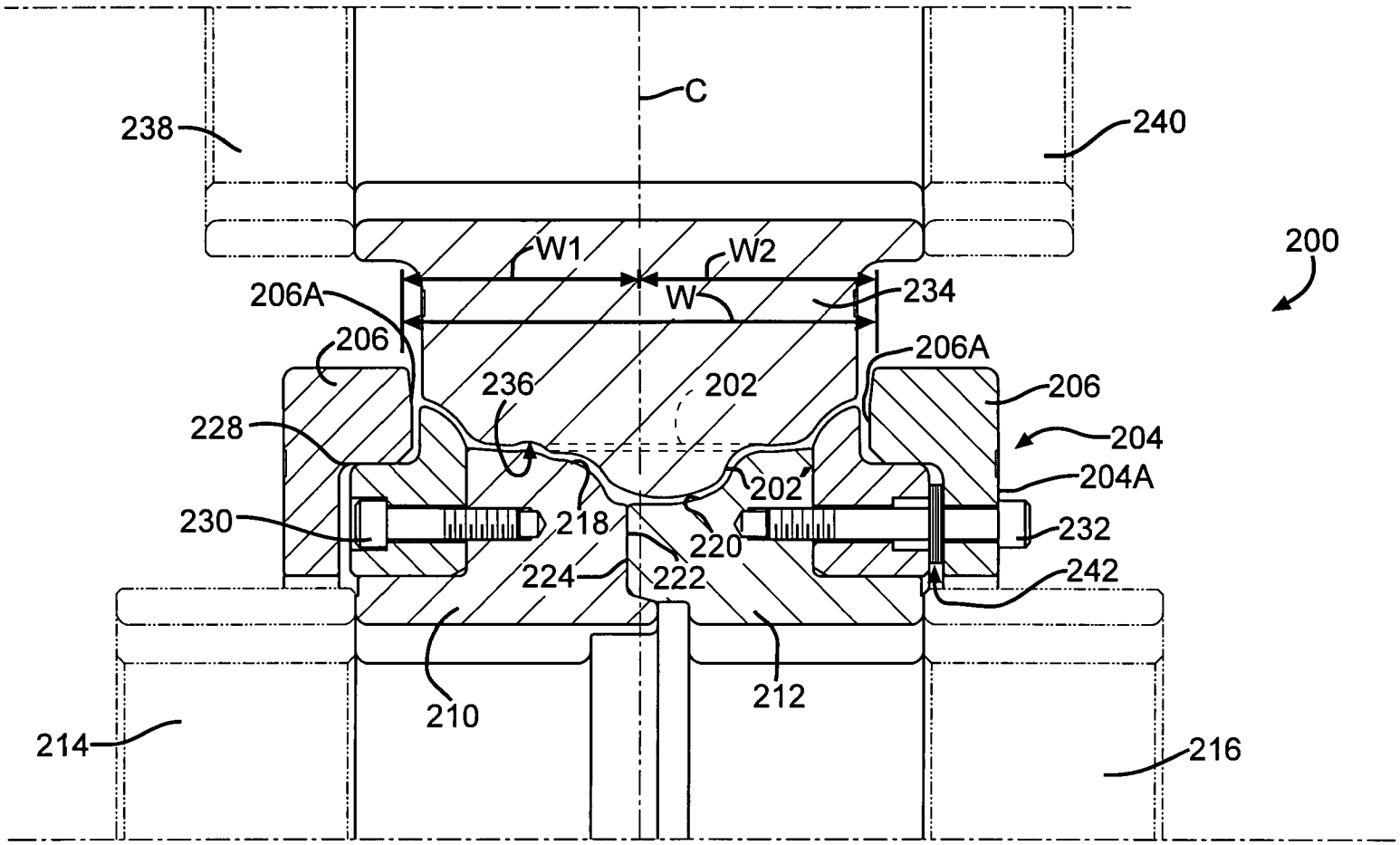
FIG. 1 (PRIOR ART)
FIG. 1 is a partial elevational view of a prior art wheel rim forming apparatus.
Figure 6:
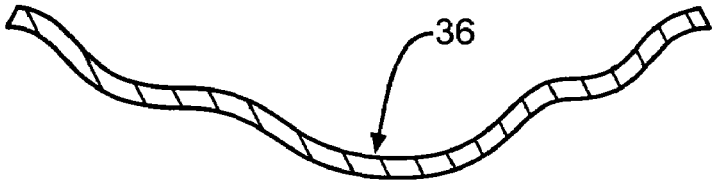
FIG. 6 is a schematic diagram of a partially shaped wheel rim produced by a metal forming operation.

Referring again to step 16 the wheel rim roll forming operation is operative to produce the partially formed wheel rim 36 shown in FIG. 6. To accomplish this, a wheel rim forming apparatus according to the present invention indicated generally at 300 in FIG. 8, is used. The wheel rim forming apparatus 300 includes an inboard spacer 302 that is used to position and secure an inboard roll 306. As described above, the inboard roll 306 defines a first portion of the inner engaging face for the wheel rim preform 34. Similarly, the apparatus 300 includes an outboard spacer 304 that is used to position and secure an outboard roll 308. The inboard roll 306 and outboard roll 308, forming an inner roll assembly 310, operate substantially similarly to that of the prior art wheel rim forming apparatus 200 described with respect to prior art FIG. 1 and, therefore, will not be described here again. Similarly, an upper roll member 312 is positioned above the inner roll assembly 310 for forming the wheel rim as described with respect to prior art FIG. 1.

Figure 9A:
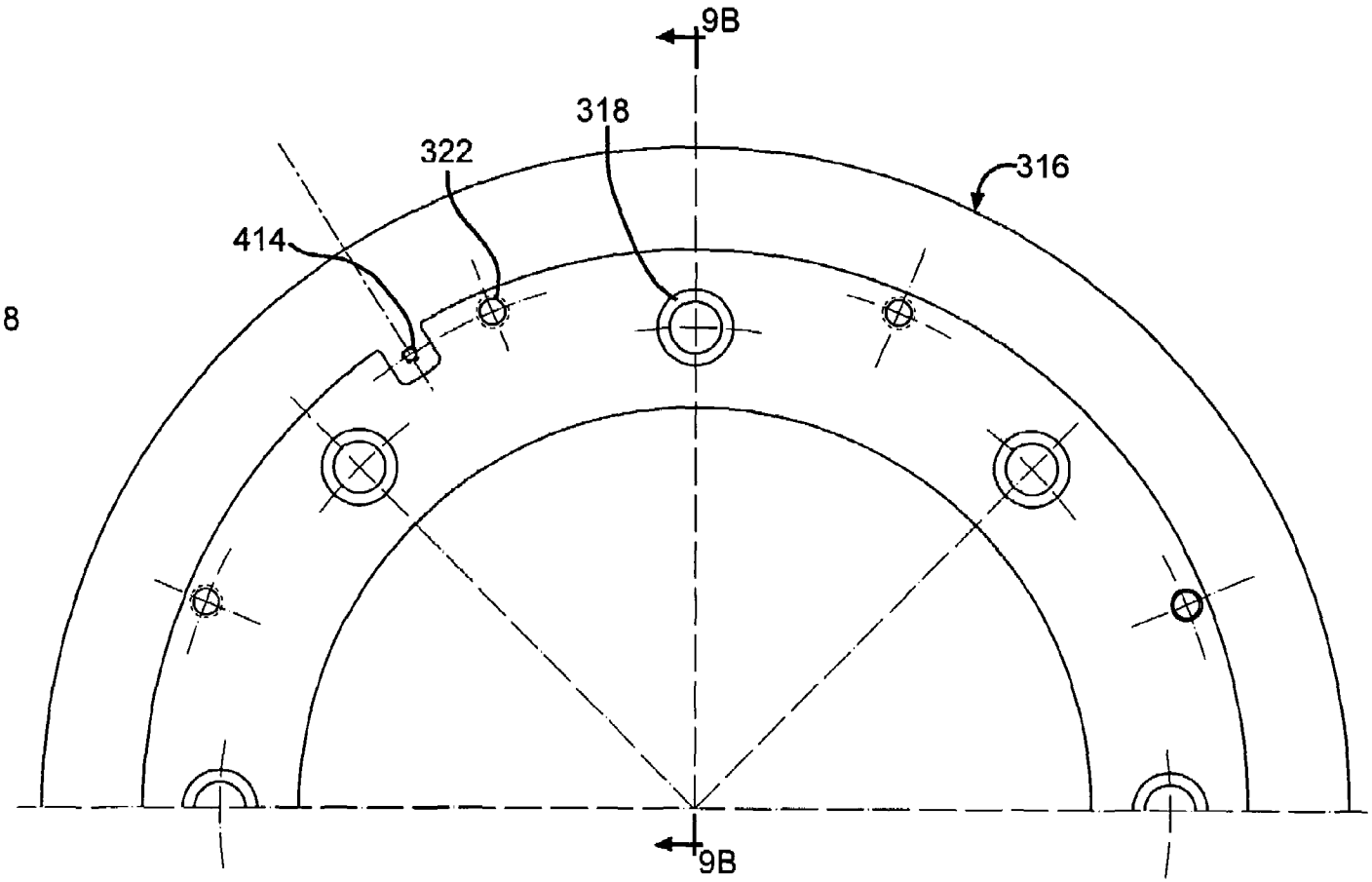
FIG. 9A is a partial elevational view a lateral ring of the wheel rim forming apparatus shown in FIG. 8, in accordance with the present invention.
Figure 9B:
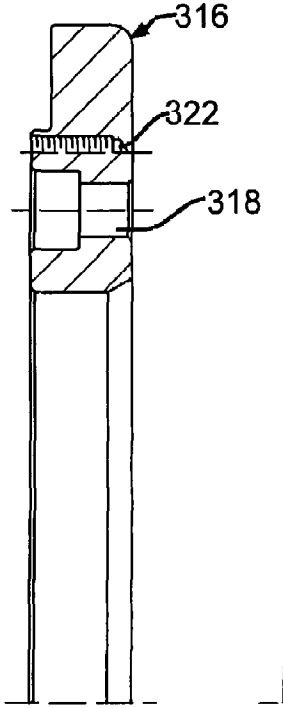
FIG. 9B is a partial cross-sectional view of the lateral ring taken along line 9B—9B of FIG. 9A.

The upper roll member 312 is positioned and held within the roll forming apparatus 300 by a pair of spacers 314 (shown schematically in FIG. 8) positioned on the opposed sides thereof. The wheel rim forming apparatus 300 includes a pair of cylindrical lateral rings 316 placed about the inner roll assembly 310. The rings 316 are secured to the inner roll assembly 310 by a plurality of bolts 320 that are threadably received in the inner roll assembly 310. Each lateral ring 316 (illustrated more clearly in FIGS. 9A and 9B) is substantially similar and thus only one lateral ring will be described.

In FIG. 8, the lateral ring 316 is secured with the inboard roll 306 by a plurality of bolts 320 that pass through a plurality of first bores 318 formed therethough equidistantly spaced about the ring 316 and which are threadably received in threaded openings provided in the associated rolls 306 and 308. The lateral ring 316 also includes a plurality of second smaller bores 322 formed therein. The second bores 322 are adapted to receive a bolt 324 that passes through a nut 326 (described below) and is threadably received in an opening provided in the lateral ring 316.

In the present invention, the wheel rim forming apparatus 300 includes a guide ring assembly, indicated generally at 328 that allows an operator of the wheel rim forming apparatus 300 to readily adjust the position of the associated guide rings 329 of the wheel rim preform apparatus 300 to accommodate for tolerance variations in the flared wheel rim preform 34. As with the lateral rings 316, a pair of guide ring assemblies 328 are used with the wheel rim forming apparatus 300. Since each guide ring assembly 328 is substantially similar, the assembly will only be described with respect to one of the guide ring assemblies 328.

The illustrated guide ring assembly 328 includes a guide ring 329, best shown in FIGS. 10A and 10B. The guide ring 329 is generally cylindrical in shape with an outer peripheral flanged portion 330. The thickness of the guide ring 329 at the outer peripheral flanged portion 330 is relatively larger than a thickness of the guide ring 329 at an inner peripheral portion 332 thereof. The inner peripheral portion 332 of the guide ring 329 has a first thickness portion 334 and a second thickness portion 336. The first thickness portion 334 is preferably adjacent the outer peripheral flanged portion 330 of the guide ring 329. The second thickness portion 336 is preferably reduced compared to the thickness of the first thickness portion 334. Therefore, a step 338 is formed at the transition from the first thickness portion 334 of the guide ring 329 to the second thickness portion 336 thereof.

The guide ring 329 also includes a plurality of equidistantly spaced vertically extending bores 340 formed through the outer peripheral flanged portion 330 thereof. In the illustrated embodiment, 12 of such bores 340 are provided in the flanged portion 330. The flange bores 340 are adapted to each receive an actuator 346, best illustrated in FIG. 11. Each actuator 346 is generally cylindrical in shape and includes a main body 348, a spring 347, and a lower flanged portion 349.

The actuator 346 has a diameter that allows the main body 348 to slide up and down within the flange bore 340. The button 348 is also preferably sized such that an upper portion of the main body 348 is situated in the flange bore 340 while a lower portion of the main body 348 is situated within a first groove or channel 354 provided in the guide ring 329.

The lower portion 349 of the main body 348 preferably has a relatively larger diameter than the diameter of the main body 348 and therefore, larger than the diameter of the flange bore 340 so that the lower portion 349 of the button 348 seats against an inner surface 344 of the flanged portion 330 and cannot pass through the bore 340. The spring 347 is preferably mounted about the main body 348 with a lower portion of the spring 347 seated against the lower flanged portion 349 of the actuator and an upper portion of the spring 347 seated against the inner surface 344 of the flanged portion 330. Thus, the spring 347 is operative to bias the actuator 346 dowwardly or inwardly towards the first channel 354 of the guide ring 329. When an upward force is applied to the actuator 346 to compress and counter the spring force applied by the spring 347, a part of the upper portion of the main body 348 protrudes through the flanged portion 330 of the guide ring 329 as shown on the left hand side of FIG. 8. Although the actuator 346 has been described as being generally cylindrically shaped, it can be appreciated that any suitably sized and shaped actuator 346 can be used in accordance with the invention.

The guide ring 329 further includes a plurality of first horizontally extending bores 352 that are formed through the inner peripheral portion 332 thereof. Preferably, the number of flange bores 340 corresponds to the number of first bores 352. It is preferred that the flange bores 340 and first bores 352 are equally spaced around the guide ring 329. In a preferred embodiment, twelve flange bores 340 and twelve first bores 352 are formed about the guide ring 329. The flange bores 340 and the first bores 352 are also preferably positioned generally perpendicularly to each other. However, it can be appreciated that the bores 340 and 352 can be positioned at other angles relative to each other if so desired. Also, at each position of the first bores 352, is the first channel 354 of the guide ring 329. Each channel 354 defines a "stop". The purpose of the "stops" will be described in greater detail below.

The inner peripheral portion 332 of the guide ring 329 further includes a plurality of second bores 356 formed therethrough. It is preferred that the second bores 356 are located approximately ninety degrees (90°) from each other around the circumference of the inner peripheral portion 332 of the guide ring 329. Therefore, in the preferred embodiment, there are four second bores 356 formed around the circumference of the guide ring 329. It is also preferred that the first bores 352 pass through the first thickness portion 334 of the inner peripheral portion 332 of the guide ring 329 and that the second bores 356 pass through the second thickness portion 336 of the inner peripheral portion 332 of the guide ring 329. A plurality of bolts 358, at the second bore 356 positions, are used to attach the guide ring 329 to a bolt or threaded member 360 of the guide ring assembly 328.

Again, a pair of bolts 360 are preferably used, one on each of the sides of the apparatus 300, with only one side of the apparatus 300 being described. As best shown in FIGS. 12A and 12B, the bolt is 360 is adapted to threadably receive the bolt 358 in a bore 362 formed therein. The bolt 360 is generally cylindrical in shape and is interposed between the guide ring 329 and the lateral ring 316. The bolt 360 includes a generally smooth inner surface 364 and an outer surface 366 having an inboard portion 368 and an outboard portion 370. The outboard portion 370 of the bolt 360 is preferably sized such that the outboard portion 370 fits within the step 332 formed in the guide ring 329. The inboard portion 368 of the bolt 360 preferably is provided with external threads 371. The purpose of these threads 371 will be described in more detail below. The threads 371 can have any pitch, depth and other thread characteristic as desired depending on the desired operational characteristics of the mechanism. Regardless of the design of the threads 371, the threads of the bolt 360 are preferably adapted to cooperate with internal threads formed on a nut 326.

The nut 326, more clearly illustrated in FIGS. 13A and 13B, is also formed as a generally cylindrical member. The nut 326 has an inner diameter and outer diameter. The inner and outer diameters of the nut 326 define a thickness of the nut 326. The inner diameter of the nut 326 is provided with internal threads which mate with the external threads 371 of the bolt 360. It is further preferred that the outer diameter of the nut 326 is sized such that the nut 326 can fit within the guide ring 329.

The outer surface of the nut 326 also defines a side face 372. The side face 372 is generally flat and includes a plurality of bores 374 formed therethrough that are positioned equidistantly about the circumference of the face 372. In a preferred embodiment, there are eight such bores 374 formed through the nut 326. The bores 374 are preferably formed such that bolts 324 adapted to fit within each of the bores 374 can be recessed therein such that the head of the bolt 324 does not extend past the side face 372. The bores 374 are also equally spaced about the side face 372 of the nut 326 and extend through the nut 326 so that the bolts 324 can threadably engage the threaded openings 322 of the lateral ring 316. An opposite side face 376 of the nut 326 is stepped and includes an outer portion 378 and an inner portion 380. The outer portion 378 is flanged relative to the inner portion 380 of the side face 376. Thus, the bolts 324 secure the nut 326 to the lateral ring 316.

The nut 326 includes an outer diameter face 386 which is generally flat and has at least one pair of recesses 382 and 384 formed therein. The first recess 382 of the pair is formed in the outer diameter face 386 is positioned closer to the side face 372 of the nut 326. The second recess 384 is formed closer to the side face 376 of the nut 326. It is preferred that the first recess 382 is larger than the second recess 384. It is also preferred that the first recess 382 is generally box-shaped and adapted to receive a locking assembly 388.

The locking assembly 388 can be seen more clearly in FIGS. 14 and 15. It can be appreciated that the first recess 382 can have any shape such that the recess 382 can accommodate any size or shape locking assembly 388. The locking assembly 388 includes an inner sleeve or member 390, an outer lock or member 392, and a spring 394. The locking assembly 388 cooperates with the actuator 346, described above. The outer lock 392 is formed having an outer dome-shaped head 396 and a lower flanged base 398. The spring 394 is positioned to bias the button 396 in an upward or outward direction when the components are installed in the apparatus 300 as shown in FIG. 8.

The outer lock 392 preferably includes a hollow interior portion 401 such that an upper end of the spring 394 is disposed therein. When the head 396 is depressed, the spring 394 allows a portion of the outer lock 396 to be moved in an inward direction towards and into the inner sleeve390.

The inner sleeve 390, also shown in FIGS. 14 and 15, is adapted to receive the outer lock 392 therein. The sleeve 390 is a hollow generally cylindrical sleeve that fits about the outer lock 392 and is sized such that the sleeve 390 can be disposed, preferably in press fit, within the first recess 382 of the nut 326. An inner portion 402 of the sleeve 390 is adapted to receive the head 396 and the base 398 of the upper lock 392. Therefore, it is preferred that an inner surface of the sleeve 390 has a first inner dimension 404 that is relatively larger than a second inner dimension 406. The first (relatively larger) inner dimension 404 is sized to accommodate the flanged base 398 of the upper lock 392 and the second (relatively smaller) inner dimension 406 is sized to accommodate a main body portion 399 of the upper lock 392. An outboard surface 408 of the sleeve 390 is uniform along its entire length except for a stepped portion 412.

The second recess 384 of the nut 326 is preferably threaded and sized to accommodate a fastener or screw 414 such that a head of the screw 414 fits within the second recess 384 and does not extend past an outer peripheral surface of the nut 326. The purpose of this screw 414 is to secure the locking assembly 388 to the nut 326. Thus, it is preferred that the head of the screw 414 contacts a portion of the stepped portion 412 of the sleeve 390 as shown in FIG. 8. The screw 414 is threadably disposed in a threaded opening 379 provided in the nut 326 to there secure the locking assembly 388 therewith. The nut 326 is provided with internal threads 417 formed thereon that cooperate with the external threads 371 formed on the bolt 360. Therefore, it is preferred that the threads 417 of the nut 326 have a similar size and shape as the threads 371 of the bolt 360.

The apparatus 300 further includes a key, indicated generally at 420, shown in FIGS. 16A and 16B. The key 420 is generally rectangular shaped and includes an opening 422. The opening 422 is adapted to receive a suitable fastener (not shown) for securing the key 420 to the lateral ring 316. To accomplish this, the lateral ring 316 is provided with a threaded opening 414 shown in FIG. 9A. Alternatively, the structure of one or more of the components of the apparatus 300, including one or more of the components of the guide ring assembly 328 and/or the locking assembly 388, can be other than illustrated if so desired.

The operation of the guide ring assembly 328 will now be described. During operation of the wheel rim forming apparatus 300, it is preferred that the guide ring assembly 328 is secured with the lateral ring 316 and the first roll assembly 310 such that the flared wheel rim preform 34 that is positioned on the apparatus 300 in a predetermined position. In particular, it is desired that the flared wheel rim preform 34 is positioned with its opposed flanged ends generally equidistantly spaced with respect to the centerline C of the apparatus. Using the guide ring assembly 328 of the present invention, the position of the flanged ends of the wheel rim preform 34 can be changed relative to the centerline C without disassembling a portion of the wheel rim forming apparatus 300. To adjust the position of the flanged ends of the flared wheel rim preform 34, an exposed head 345 of the actuator 346 is depressed so as to be moved in an inward direction. In order for the head 345 of the actuator 346 to be accessible, (i.e., the head 345 is located above or outward relative to an outer surface 342 of the guide ring 329), the guide ring assembly 328 is positioned such that one of the actuators 346 is positioned adjacent the lock assembly 388, as shown on the left hand side of FIG. 8. In this position, the head 392 of the outer lock 392 of the lock assembly 388 engages and biases the actuator 346 outwardly so that it protrudes past the outer surface 342 of the guide ring 329.

Depressing the actuator 346 causes the outer lock 392 of the lock assembly 329 to be depressed. When the outer lock 392 of the lock assembly 392 is depressed, the guide ring 329 can be rotated. Rotation of the guide ring 329 causes rotation of the bolt 360 (which is connected to the guide ring 329 by the bolt 358), via the threaded connection between the bolt 360 and the nut 326. Depending upon the rotation of the guide ring 329, either in a first or clockwise direction or in a second or counterclockwise direction, the position of the guide ring 329 will be axially adjusted either closer toward the centerline C or moved further away from the centerline C of the apparatus. When the outer lock 392 of the lock assembly 392 encounters one of the channels 354 formed on the flange 330 of the guide ring 329, the lock assembly spring 394 will bias the outer lock 392 upward and into the channel or "stop" 354 thereby preventing any further rotational motion of the guide ring 329.

It is preferred that the guide ring 329 on the outboard side of the apparatus 300 be operated in the same manner to position and secure the wheel rim preform with the apparatus 300. Since typically the position the of the flared wheel rim preform 34 only needs to be adjusted in small increments on the apparatus 300 prior to performing step 16, it is preferred that the rotation of the guide ring assembly 328 between "stops" 354 causes relatively small axial movement of the components. In a preferred embodiment, moving the guide ring 329 from an initial "stop" 354 to the next "stop" 354 causes axial movement of the guide ring 329 an axial distance of approximately one-half millimeters (0.5 mm). It can be appreciated that the axial distance the assembly can be moved with each incremental rotation can be any desired distance. Alternatively, the amount of adjustment of the guide ring 329 can be other than described if so desired.

It can be appreciated that typically during adjustment of the apparatus 300, the guide ring assembly 328 on the one side is preferably rotated in an opposite direction as that of the guide ring assembly 328 on the opposite side. For example, if the shape of the flared wheel rim preform 34 is "off center" in the outboard direction (to the left in FIG. 8), then the guide ring 328 on the left side is rotated in a first direction so that the left side guide ring 328 moves the flared wheel rim preform 34 to the right in FIG. 8. As a result of this movement, the guide ring 328 on the right side in FIG. 8 is rotated in the opposite direction to move its associate guide ring to the right in FIG. 8. When both of the guide ring assemblies have been moved and then locked into their new positions, the wheel rim forming operation of step 16 can be performed to form the predetermined shape of the partially formed wheel rim 36. It can be appreciated that the rotation of the guide ring assembly 328 from one "stop" 354 to the next "stop" 354 can be repeated as desired in order to properly position the flared wheel rim preform 34 on the apparatus 300 in a desired position.

Figure 7:
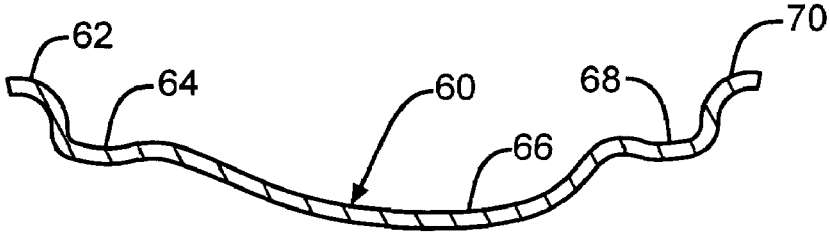
FIG. 7 is a schematic diagram of the finished wheel rim produced by an expanding operation.

As shown in FIGS. 7 and 17, the "expanded" finished wheel rim 60 includes an inboard tire bead seat retaining flange 62, an inboard tire bead seat 64, a generally axially extending well 66, and an outboard tire bead seat 68, and an outboard tire bead seat retaining flange 70. In step 24, the wheel rim 60 is secured to a preformed wheel disc, indicated generally at 80 in FIG. 17, by welding to produce the finished vehicle wheel 100. As shown in FIG. 17, the wheel disc 80 includes a central mounting portion 82, an intermediate bowl-shaped portion 84, and an outer portion 86 which includes a flange 88. The wheel disc 80 can be formed from steel, aluminum, or alloys thereof depending upon the construction of the associated wheel rim 60.

While the invention has been illustrated and described as forming a wheel rim 60 for use in a bead seat attached vehicle wheel 100, the invention can be practiced to form an associated wheel rim for use in other types of wheels. For example, as shown in FIG. 18, the invention can be practiced to produce a wheel rim 200 which is secured to a preformed wheel disc 202 to produce a "bead seat" attached vehicle wheel 204. Also, as shown in FIG. 19, the invention can be practiced to produce a "partial" wheel rim 210 which is secured to a "full face" wheel disc 212 to produce a full face vehicle wheel 214. In addition, as shown in FIG. 20, the invention can be practiced to produce a "partial" wheel rim 220 which is secured to a full face wheel disc 222 to produce a full face modular vehicle wheel 224.

One advantage of the apparatus 300 of the present invention allows the associated guide ring assembly 328 to be quickly and easily adjusted to accurately position the flared wheel rim preform 34 on the apparatus 300. In the prior art apparatus 200, adjustment of the flared wheel rim preform 202 on the apparatus 200 required the removal of a number of components, namely the bolts 232, the guide ring 204, and the addition or removal of shims 242. Thus, it can be seen that the guide ring assembly 328 of the apparatus 300 of the present invention having the locking assembly 388 provides a "quick adjust" feature which does not require disassembly of any of the components thereof.

Also, while the present invention has described and illustrated as an apparatus 300 wherein the guide ring assembly 328 is adjusted by rotational movement to cause it to move axially, it is appreciated that the guide ring assembly 328 could be adjusted by axial movement which similarly would cause it to move axially. For example, as shown in FIG. 21, one of an outer member 326' and an inner member 360' could have an axially extending rail (which could have a dovetail shape for example), and the other one of the outer member 326' and the inner member 360' could have a correspondingly shaped channel so as to be received therein and to allow relative axial movement therebetween. Such a design could include a similar locking assembly 388 as that described and illustrated above or could include any suitable locking assembly which functions in a similar manner to that of the locking assembly 388.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A wheel rim roll forming apparatus comprising:

an inner roll assembly adapted to support a flared wheel rim preform thereon, the inner member including an outer surface having a predetermined profile and defining a centerline of the apparatus;

an upper roll member supported relative to the inner roll assembly, the upper roll member having an inner surface having a predetermined profile adapted to engage the flared wheel rim preform to produce a partially formed wheel rim having a desired profile;

a pair of axially adjustable guide ring assemblies operatively supported by the inner roll assembly and operatively disposed adjacent an associated end of the flared wheel rim preform, wherein each of the guide ring assemblies includes a generally cylindrical guide ring having a plurality of spaced apart bores formed through an outer peripheral flanged portion thereof and a releasable actuator adapted to be operatively disposed in a selected one of the plurality of bores; and a lateral ring secured to each one of the guide ring assemblies, the lateral rings adapted to engage flanged ends of the wheel rim preform;

wherein the guide ring assemblies are axially adjustable by releasing the actuators from engagement in a selected one of the plurality of bores and moving the guide rings assemblies by one of a rotational or axial movement to a desired position.

2. The wheel rim roll forming apparatus of claim 1 wherein the actuator is a spring loaded actuator.

3. The wheel rim roll forming apparatus of claim 1 wherein the guide ring assemblies are adjustable by rotational movement.

4. The wheel rim roll forming apparatus of claim 1 wherein the guide ring assemblies are adjustable by axial movement.

5. The wheel rim roll forming apparatus of claim 1 further including a pair of locking assemblies adapted to maintain the actuators in a selected one of the plurality of bores.

6. The wheel rim roll forming apparatus of claim 1 wherein the adjustment of the guide ring assemblies is in axial increments of approximately one-half millimeters (0.5 mm).

7. A wheel rim roll forming apparatus comprising:

an inner roll assembly adapted to support a flared wheel rim preform thereon, the inner member including an outer surface having a predetermined profile and defining a centerline of the apparatus;

an upper roll member supported relative to the inner roll assembly, the upper roll member having an inner surface having a predetermined profile adapted to engage the flared wheel rim preform to produce a partially formed wheel rim having a desired profile;

at least one axially adjustable guide ring assembly operatively supported by the inner roll assembly and operatively disposed adjacent an associated end of the flared wheel rim preform, wherein the at least one guide ring assembly includes a generally cylindrical guide ring having a plurality of spaced apart bores formed through an outer peripheral flanged portion thereof and a releasable actuator adapted to be operatively disposed in a selected one of the plurality of bores; and a lateral ring secured to the at least one guide ring assembly, the lateral ring adapted to engage an associated flanged end of the wheel rim preform;

wherein the at least one guide ring assembly is axially adjustable by releasing the actuator from engagement in a selected one of the plurality of bores and moving the at least one guide ring assembly by one of a rotational or axial movement to a desired position.

8. The wheel rim roll forming apparatus of claim 7 wherein the actuator is a spring loaded actuator.

9. The wheel rim roll forming apparatus of claim 7 wherein the guide ring assemblies are adjustable by rotational movement.

10. The wheel rim roll forming apparatus of claim 7 wherein the guide ring assemblies are adjustable by axial movement.

11. The wheel rim roll forming apparatus of claim 7 further including a pair of locking assemblies adapted to maintain the actuators in a selected one of the plurality of bores.

12. The wheel rim roll forming apparatus of claim 7 wherein the adjustment of the guide ring assemblies is in axial increments of approximately one-half millimeters (0.5 mm).

13. A wheel rim roll forming apparatus comprising:

an inner roll assembly adapted to support a flared wheel rim preform thereon, the inner member including an outer surface having a predetermined profile and defining a centerline of the apparatus;

an upper roll member supported relative to the inner roll assembly, the upper roll member having an inner surface having a predetermined profile adapted to engage the flared wheel rim preform to produce a partially formed wheel rim having a desired profile;

at least one axially adjustable guide ring assembly operatively supported by the inner roll assembly and operatively disposed adjacent an associated end of the flared wheel rim preform, wherein the at least one guide ring assembly includes a generally cylindrical guide ring having a plurality of spaced apart bores formed through an outer peripheral flanged portion thereof and a spring loaded releasable actuator adapted to be operatively disposed in a selected one of the plurality of bores; and a lateral ring secured to the at least one guide ring assembly, the lateral ring adapted to engage an associated flanged end of the wheel rim preform;

wherein the at least one guide ring assembly is axially adjustable by releasing the actuator from engagement in a selected one of the plurality of bores and moving the at least one guide ring assembly by rotational movement to a desired position.

14. The wheel rim roll forming apparatus of claim 13 further including a pair of locking assemblies adapted to maintain the actuators in a selected one of the plurality of bores.

15. The wheel rim roll forming apparatus of claim 13 wherein the adjustment of the guide ring assemblies is in axial increments of approximately one-half millimeters (0.5 mm).

* * * * *